US005671832A

United States Patent [19]

London et al.

[11] Patent Number: 5,671,832

[45] Date of Patent: Sep. 30, 1997

[54] COMBINATION LUGGAGE PIECES AND CONNECTOR

[75] Inventors: Wallace London, Baltimore; James S. Deutschendorf, Owings Mills, both of Md.

[73] Assignee: Clemco Products, Inc., Baltimore, Md.

[21] Appl. No.: 646,909

[22] Filed: May 8, 1996

[51] Int. Cl.[6] ..... A45C 5/14; A45C 13/38; B65D 71/00

[52] U.S. Cl. ..... 190/108; 190/18 A; 190/102; 190/115; 294/150; 294/152; 294/157

[58] Field of Search ..... 190/18 A, 102, 190/108, 115, 26; 383/4, 37, 22; 150/111; 7, 8, 13, 24, 37; 294/150–157

[56] References Cited

U.S. PATENT DOCUMENTS

| | | | |
|---|---|---|---|
| 2,707,035 | 4/1955 | Lashley | 190/108 X |
| 3,606,372 | 9/1971 | Browning | 190/18 A |
| 3,958,731 | 5/1976 | Riedle | 190/108 X |
| 3,960,252 | 6/1976 | Cassimally | 190/18 A |
| 4,062,429 | 12/1977 | Tabor et al. | 190/18 A |
| 4,094,391 | 6/1978 | Ratchford | 190/18 A |
| 4,406,353 | 9/1983 | Walker | 190/18 A |
| 4,424,841 | 1/1984 | Smith | 190/108 X |
| 4,442,960 | 4/1984 | Vetter | 190/108 X |
| 4,538,709 | 9/1985 | Williams et al. | 190/18 A |
| 4,598,803 | 7/1986 | Ghiassi | 190/108 |
| 4,759,431 | 7/1988 | King et al. | 190/18 A |
| 4,792,025 | 12/1988 | Thomas | 190/18 A |
| 4,881,684 | 11/1989 | Chinman | 190/115 |
| 4,911,271 | 3/1990 | Stanley | 190/102 |
| 4,974,709 | 12/1990 | Furlow et al. | 190/108 X |
| 5,031,766 | 7/1991 | Cohen | 206/289 |
| 5,303,805 | 4/1994 | Hauser | 190/18 A |
| 5,311,972 | 5/1994 | Plath | 190/108 X |
| 5,353,900 | 10/1994 | Stilley | 190/115 X |
| 5,354,131 | 10/1994 | Mogil | 190/108 X |
| 5,407,111 | 4/1995 | Lanouette et al. | 383/4 X |

FOREIGN PATENT DOCUMENTS

| | | | |
|---|---|---|---|
| 4394420 | 7/1991 | European Pat. Off. | 383/4 |
| 2358124 | 2/1978 | France | 190/102 |
| 347220 | 4/1931 | United Kingdom | 190/102 |
| 9318684 | 9/1993 | WIPO | 190/18 A |

*Primary Examiner*—Sue A. Weaver

[57] ABSTRACT

A carrying luggage having wheels and an extendable handle, a carried luggage which may be taller than the carrying luggage and having a handle, and a releasable connector for engaging the grips of the handles and supporting the grip of the carried luggage at or adjacent to the grip of the carrying luggage. The releasable connector may be a strap with a buckle, or may have a girdle strap extending around the rods of the extendable handle of the carrying piece, an attaching strap with a buckle attached to the girdle strap, and a suspension strap or straps connected to the girdle strap and extending over the grip of the extendable handle.

28 Claims, 3 Drawing Sheets

COMBINATION LUGGAGE PIECES AND CONNECTOR

BACKGROUND OF THE INVENTION

The present invention relates to the combination of plural pieces of luggage and a connector for connecting one luggage piece to another.

It has been recognized that it is desirable to provide a first piece of luggage which may have wheels so that it may be rolled over the ground, and to have a second piece of luggage which is attached to and carried by the first piece of luggage. In King et al U.S. Pat. No. 4,759,431, such an arrangement is provided, the first piece (the carrying piece) having wheels and an extendable handle, and the second piece of luggage (the carried piece) being supported by a strap which extends from and is connected to the extendable handle and also passes through a handle of the carried luggage, to support it. This structure is suitable for carrying a relatively short piece of carried luggage; as disclosed, the strap extends from near the hand grip of the extendable handle to the handle of the carried luggage which is located at or below the top of the container portion of the carrying piece of luggage.

Another known construction is Browning U.S. Pat. No. 3,606,372, wherein a carrying piece of luggage has wheels and an extendable handle, and has attached to it at the upper edge of the luggage body a strap which is attached to the carried piece of luggage, the top of the carried piece of luggage being somewhat below the top of the carrying luggage.

Also of interest is Ratchford U.S. Pat. No. 4,094,391, which discloses a carrying luggage with wheels, and a hook device which extends through the handle grips of the carrying luggage and one or more pieces of carried luggage, the tops of all of the pieces of luggage being at approximately the same height.

Cohen U.S. Pat. No. 5,031,766 discloses a conventional pieces of luggage, having no wheels and a fixed handle, and a strap extending from a carried piece of luggage to the handle, the carried piece of luggage being disclosed as a triple-folded garment bag.

Williams et al U.S. Pat. No. 4,538,709 provides a garment bag which includes stretch cords and extendable arms at the bottom for supporting and carrying additional luggage.

Hauser U.S. Pat. No. 5,303,805 provides a garment bag which in the moving position has wheels and an extendable handle, together with straps which may pass through the handle of a carried luggage which is vertically shorter than the carrying luggage.

Thomas U.S. Pat. No. 4,792,025 provides a piece of wheeled luggage with a handle and a shelf extending from the surface of the luggage body when it is towed in the inclined position; a carried luggage rests on the shelf, and another piece of carried luggage rests on the inclined handle.

Cassimally U.S. Pat. No. 3,960,252 provides a suitcase which has an auxiliary frame attached to it comprising a pair of spaced wheels and a towing handle, with the towing handle being available to support additional luggage resting on the handle and on the carrying luggage.

Ghiassi U.S. Pat. No. 4,598,803 provides a carrying luggage with handles and a carried luggage in the form of a garment bag which is positioned over the top of the carrying luggage, and is connected to it by straps.

In none of the combination carrying and carried luggage pieces and supports or connectors which have been provided is there a construction which enables the carrying luggage to support a carried luggage piece of substantial height. In each of the structures provided, it would not be possible to carry a second piece of luggage from the carrying luggage if the second piece, or carried luggage, is of greater vertical height than the carrying luggage, since in those instances, the carried luggage would drag on the ground. The constructions disclosed are less stable than desired while being towed, including while making turns, due to the centrifugal force acting from the grip of the carrying luggage to the center of gravity of the carried luggage.

SUMMARY OF THE INVENTION

The present invention provides a carrying piece of luggage which has wheels for enabling the luggage to be rolled over the ground, and an extendable handle. In the preferred form, the extendable handle has a hand grip which in the retracted position is adjacent the top surface of the carrying luggage, and in the extended position, as is conventional, is at a height of about sixteen to eighteen inches above the top of the carrying luggage. A second piece of luggage, the carried luggage, is provided which has approximately the same or a greater vertical height than the carried luggage. The second piece of luggage has a carrying handle including a grip which is at the top of the carried luggage, or any attachment element capable of receiving a strap, and there is provided further a releasable connector which supports the grip of the carried luggage at or closely adjacent the grip of the handle of the carrying luggage. Consequently, the carried piece of luggage is supported at the highest part of the carrying luggage, which is at or adjacent to the grip of the extended handle of the carrying luggage, and even though the carried luggage is as long as or longer than the body of the carrying luggage, it is supported clear of the ground or floor.

The releasable connector may have a number of alternate configurations. In a first configuration, the releasable connector is a strap of flexible material having a buckle. In another embodiment, the releasable connector comprises a girdle strap for encircling the rods of the extendable handle, a hanger structure attached to the girdle strap and depending from the grip of the extendable handle, and an attaching strap attached to the girdle strap. The girdle strap may comprise a web and buckle, or the web may have one or more elastic portions. Other constructional aspects of the preferred embodiments are disclosed below.

Among the objects of the present invention are to provide a combination of a wheeled carrying luggage with extendable handle, a piece of carried luggage and a releasable connector for supporting the carried luggage at or near the highest part of the carrying luggage to provide improved stability while towing.

Another object of the present invention is to provide the combination of a carrying luggage of wheeled, extendable handle construction and a carried luggage which may optionally be of the same or greater height than the carrying luggage and a connector for connecting the two pieces of luggage in a manner so as to avoid dragging the carried luggage on the ground.

Still another object of the present invention is the provision of a carrying luggage having wheels and an extendable handle, a carried luggage of the same or greater height than the carrying luggage and a releasable connector for supporting a handle on the carried luggage closely adjacent the grip of the extendable handle of the carrying luggage.

Yet another object of the present invention is to provide a releasable connector which may be readily placed in position on or at the grip of an extendable handle of a first carrying luggage and support a second piece of luggage by the grip of the handle thereof.

Other objects and many of the attendant advantages of the present invention will be readily apparent from the following description, drawings, and claims.

DETAILED DESCRIPTION OF THE PREFERRED EMBODIMENTS

Figure 1:
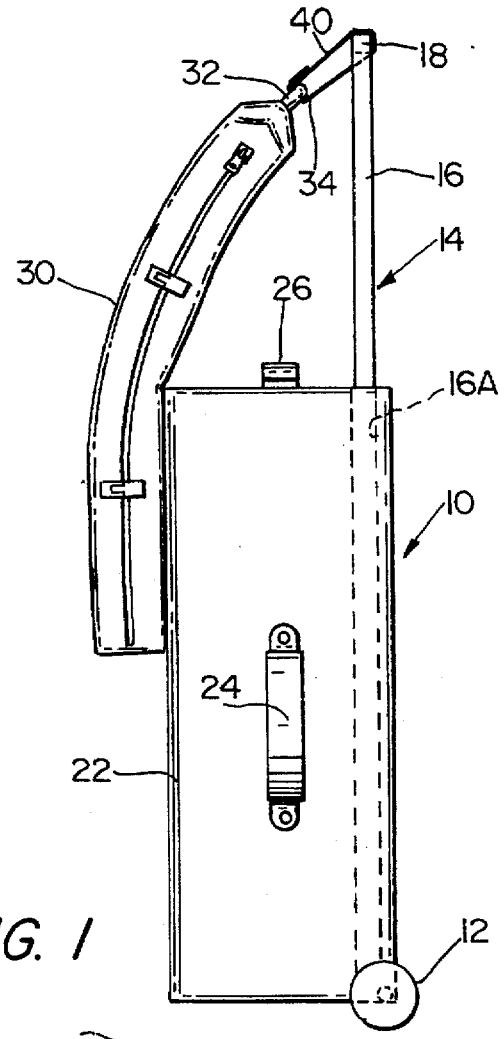
FIG. 1 is an elevational view of a piece of wheeled luggage, a garment bag, and a connector.

Referring now to the drawings, wherein like or corresponding reference numerals are used for like or corresponding parts throughout the several views, there is shown in FIG. 1 a piece of luggage 10 which comprises a pair of supporting wheels 12, and an extendable handle 14 comprising, in known fashion, a pair of spaced parallel rods 16 joined at their ends with a transverse grip 18. The luggage 10 comprises a pair of spaced tubes 16A which slidably receive the rods 16 of handle 14. Alternatively, the handle 14 may comprise a single longitudinally extending element which is telescopically received in a correspondingly shaped receiving tube in the luggage 10. The luggage 10 will be seen to provide a container for the carrying of clothing, etc., and has at least one movable wall, in this case the wall adjacent the zipper 22, to provide access into the luggage 10; fixed handles 24 and 26 may also be provided on luggage 10.

As will be understood, although a luggage with two wheels and an extendable handle has been illustrated in FIG. 1, other conventional wheeled luggage may be provided such as luggage having four wheels and a pivoted handle. In both types of wheeled luggage, the grip of the handle is movable between a stored position in which the grip is closely adjacent the body of the luggage 10 and an extended position in which the grip is remote from and at a higher elevation than the walls forming the luggage 10.

There is also shown in FIG. 1 a second luggage 30 which may be, as shown therein, a garment bag having a conventional handle 32 with a transverse grip 34. The garment bag 30 will be seen to have substantial vertical height, which is greater, for instance, than the height of the luggage 10. The second piece of luggage, as is conventional, is provided with walls which may be of fabric, and thus provides a second container for objects such as clothing carried on hangers. Handle 32 will be seen to be at the top of garment bag 30.

Figure 1A:
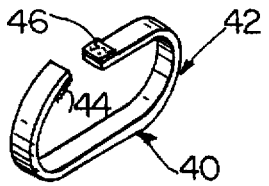
FIG. 1A is a perspective view of the releasable connector shown in FIG. 1.

Also shown in FIG. 1 is a releasable connector 40 which is in the form of a strap of web material having buckle elements at its ends. The connector 40 is shown in FIG. 1A, where there may be seen the strap 42 and buckle parts 44, 46 for connecting the ends thereof. The strap 40 will be seen to pass partly around the grip 18 of handle 14 and partly around the grip 34 of handle 32 to thereby support the second piece of luggage 30; the second piece of luggage 30 is supported at a relatively high elevation due to the supporting of the handle 32 thereof closely adjacent the grip 18 of handle 14 when in the extended or elevated position. Consequently, the substantially long second piece of luggage, the carried piece, is held at a sufficiently high level that it may be transported without dragging on the ground. Further, the two pieces of luggage are more stable while being towed, since the center of gravity of the second luggage 30 is relatively high.

Figure 1B:
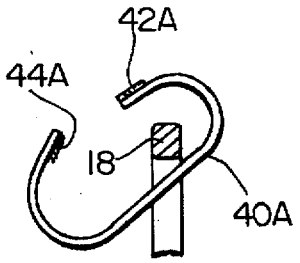
FIG. 1B is a cross-sectional view of a releasable connector and a grip of a luggage handle.

In FIG. 1B, there is shown a grip 18 which forms a handle or a part of a handle, and may be of either rigid or flexible construction. The grip 18, which forms a part of either a carrying luggage, such as the luggage 10, or a carried luggage, such as the luggage 30, has attached to it by riveting, stitching or other appropriate means a releasable connector 40A which is in the form of a strap having hook and loop elements 42A and 44A at the ends thereof. The releasable connector 40A can be placed around a grip of a piece of luggage, or other attachment point, to secure the pieces of luggage together in the manner shown on FIG. 1.

Figure 2:
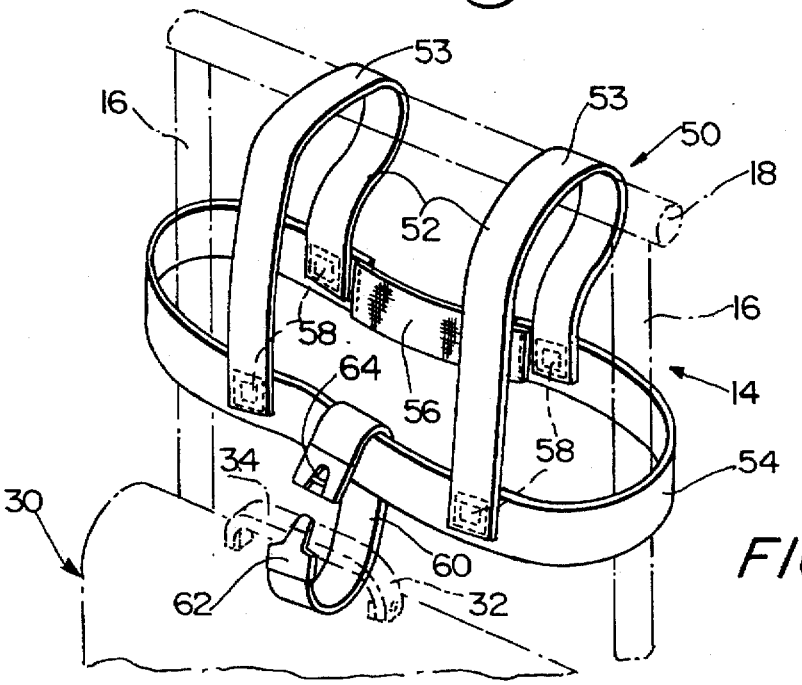
FIG. 2 is a perspective view of a first embodiment of releasable connector comprising suspension straps, a girdle strap, and an attachment strap, in association with an extendable handle.

Referring now to FIG. 2, there is disclosed an alternate releasable connector 50 which comprises a pair of horizontally spaced suspension straps 52 which are of generally inverted U-shaped configuration and position, having upper bights 53, and their lower ends secured to a girdle strap 54 which is preferably made of web material and includes an elastic portion 56. The suspension straps 52 are connected to the girdle strap 54 by any suitable construction, such as stitching, as shown, or by riveting, adhesive, fusion, etc. As is indicated in FIG. 2, the suspension straps are horizontally spaced, and are positioned over the grip 18 of the handle 14; the girdle strap 54 will be seen to encircle the rods 16 of handle 14. Thus, the suspension straps engage the grip 18 and support the girdle strap 54 from it. The spacing of the suspension straps 52 is such that the hand of a person is readily accommodated between them. The suspension straps 52 are of such length that the girdle strap 54 is located sufficiently lower than the grip 18 that fingers of a person may freely pass around the grip 18 without interference by the girdle strap 54. The girdle strap 52 passes around the rods 16 and is in contact with them due to the length thereof and the elastic section 56.

On the inside of the girdle strap 54, there are provided connectors 58, which in the embodiment shown are of hook and loop fastener construction. As will be appreciated, other forms of connectors, such as snap fasteners, may be utilized. These connectors are used to connect together the front and back runs of the girdle strap 54, for added strength and stability.

Also shown in FIG. 2, and forming part of the releasable connector 50, is an attachment strap 60 which has at the ends buckle parts 62 and 64 of conventional construction. The attachment strap 60 is stitched or otherwise secured transversely to the girdle strap 54, at a location opposite the elastic portion 56. As shown, the attachment strap 60 partly encircles the grip 34 of handle 32 of the second luggage or garment bag 30.

The releasable connector 50 may be used on different sizes of handles 14, due to the elastic portion 56 which enables the girdle strap 54 to be of varying encompassing length. Connectors 58 may be provided, as shown, or at alternate locations, and more or less than the two pairs which are shown may be utilized. These connectors 58 secure the two opposite portions or runs of the girdle strap 54 and thereby give greater stability to the releasable connector 50.

Figure 3:
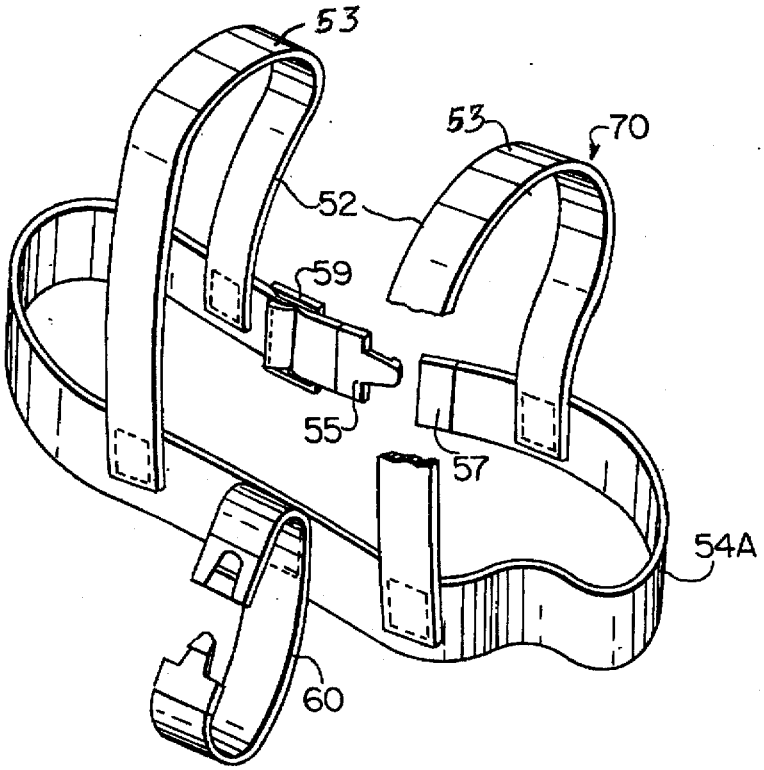
FIG. 3 is an alternate embodiment of the releasable connector, in which the girdle strap is a web with a releasable buckle.

Referring now to FIG. 3, there is shown an alternate releasable connector 70 which has, as in the embodiment shown in FIG. 2, a pair of horizontally spaced suspension straps 52, a girdle strap 54A, and an attachment strap 60. The girdle strap 54A does not have an elastic section, but instead has opposite the attachment strap 60 free ends on which are buckle portions 55 and 57. There may also be provided on the strap 54A a slide adjuster 59 to adjust the length of the girdle strap 54A, so that it may fit handles in which the rods 16 are spaced at varying distances.

Figure 4:
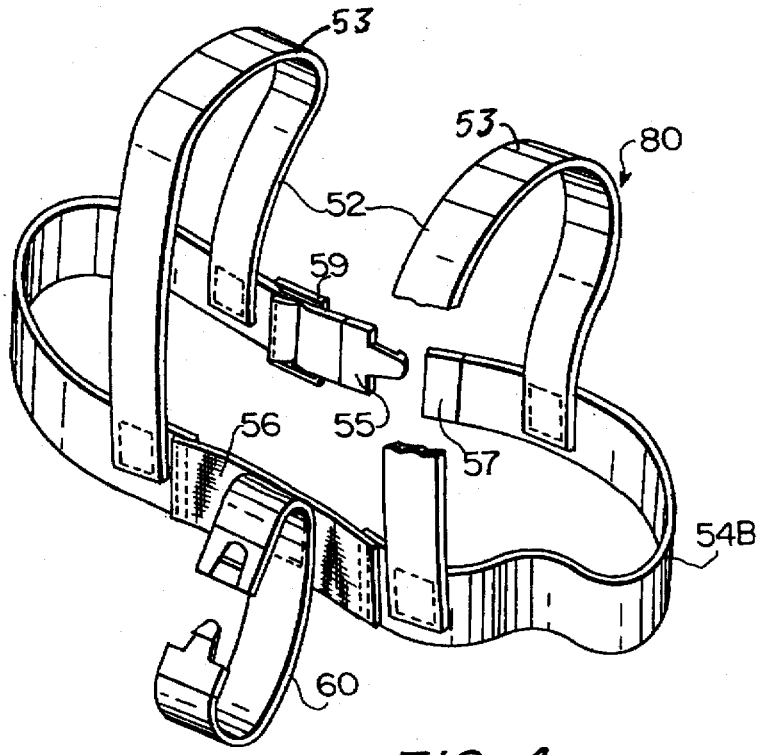
FIG. 4 is an alternate embodiment of the releasable connector in which the girdle strap has a pair of web sections, a buckle, and an elastic section.

FIG. 4 provides an alternate construction of releasable connector 80 which comprises suspension straps 52 which are attached to a girdle strap 54B having an elastic section 56 to which the attachment strap 60 is secured, as by stitching or other means. The girdle strap 54B also comprises buckle parts 55 and 57, and slide adjuster 59. In this construction, even greater size adjustment of the girdle strap 54B is possible so that the releasable connector 80 may fit an even wider range of sizes of handles.

Figure 5:
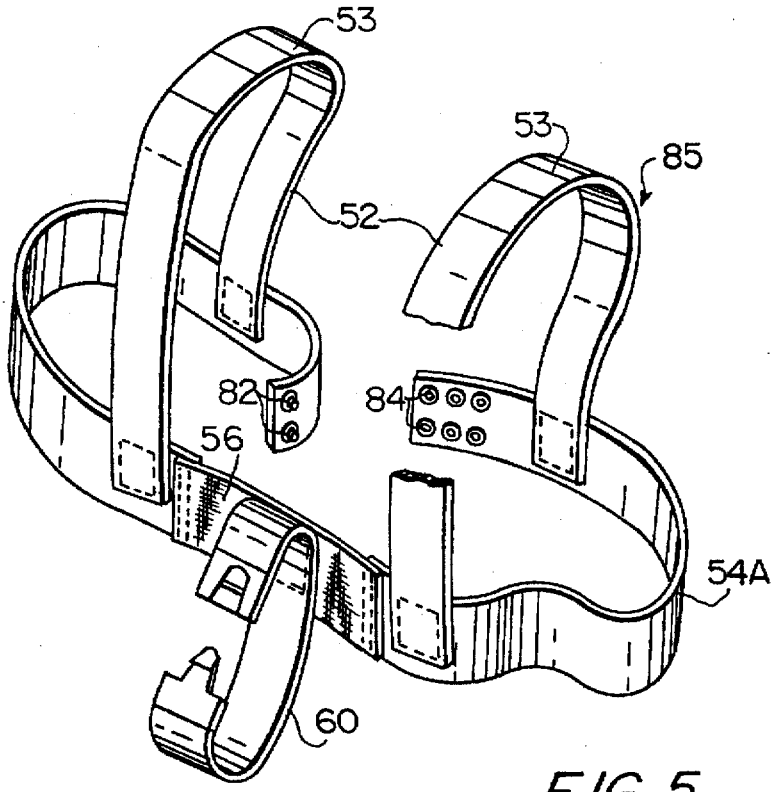
FIG. 5 is an embodiment similar to FIG. 4, but in which the girdle strap has end connectors in the form of snap fasteners.

FIG. 5 discloses a releasable connector 85 which is generally similar to the flexible connector 80, the girdle strap 54C having an elastic portion 56, and opposite elastic portion 56 there are provided snap fasteners 82 and 84 on the free ends thereof. By way of illustration, the snap fastener portions 82 are male elements and there are provided a plurality of female snap fastener portions 84 to provide for adjustment of the length of the girdle strap 54C.

Figure 6:
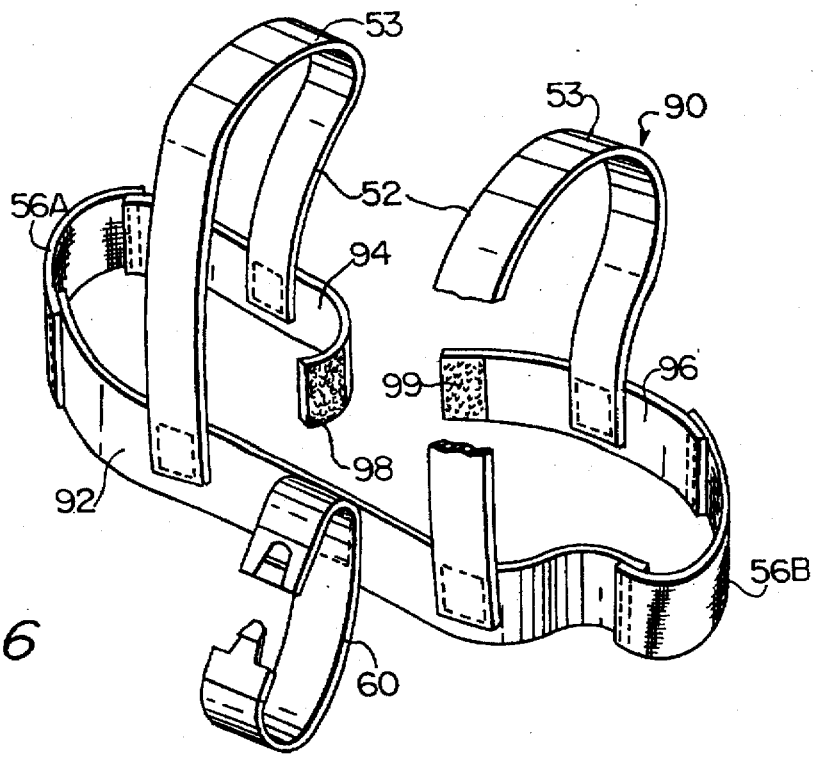
FIG. 6 is a still further embodiment in which the girdle strap has plural elastic portions, and a hook and loop type fastener for connecting the ends of the girdle strap.

Referring now to FIG. 6, there is shown a releasable connector 90 including a pair of spaced suspension straps 52, a girdle strap 54D and an attachment strap 60. The girdle strap 54D has a pair of elastic sections 56A and 56B laterally spaced and positioned to extend around the rods 16 of a handle 14. Intermediate the two elastic sections 56A and 56B are web sections 92, 94 and 96, the attachment strap 60 being secured in known manner to the web section 92. The free ends of the web sections 94 and 96 are provided with hook and loop fastener portions 98 and 99.

In each of the constructions of releasable connectors disclosed, there is the ability to quickly mount the releasable connector on a luggage handle having a pair of spaced parallel rods and a transverse grip, and to attach the releasable connector on handles of varying sizes and proportions. The attachment of the releasable connector 50, 70, 80, 85, 90 to the handle 14 is secure, and the attachment strap 60 will securely hold the second luggage, such as a garment bag, at the elevation noted hereinabove.

Further, the herein disclosed releasable connectors 50, 70, 80, 85 and 90 do not interfere with the holding of the grip 18 of the handle 14 by a hand of the user, since there is adequate space provided for the hand of the user between the suspension straps 52, and between the grip 18 and the girdle strap 54, 54A, 54B, 54C, and 54D.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

We claim:

1. In combination, (a) a piece of luggage having walls providing a container, at least a part of a said wall being movable to provide access into said luggage, supporting wheels on said luggage, and a handle for said luggage comprising a grip and mounted for movement between a stored position and an extended position in which said grip is remote from and at a higher elevation than said walls, (b) a second piece of luggage having walls providing a second container and comprising a carrying element at a boundary of said second piece of luggage having a grip, and (c) a releasable connector supporting said grip of said second piece of luggage closely adjacent said grip of said first piece of luggage;

whereby, said second piece of luggage is supported with the grip thereof substantially at the highest part of said handle of said first piece of luggage in the extended position thereof to thereby provide improved stability to said combination due to the location of the center of gravity of said second piece of luggage while said combination is being towed.

2. The combination of claim 1, the lowest part of said second piece of luggage being above a surface engaged by said wheels.

3. The combination of claim 1, wherein said handle for said first piece of luggage comprises a pair of spaced, parallel rods and said grip, said grip being transverse to said rods.

4. The combination of claim 3, said first piece of luggage comprising structure for slidably receiving said rods.

5. The combination of claim 1, wherein said handle of said first piece of luggage comprises an elongate structure slidably received by said first piece of luggage.

6. The combination of claim 1, said releasable connector comprising a strap passing partly around said grips of said first and second pieces of luggage.

7. The combination of claim 6, said strap comprising ends with connectors.

8. The combination of claim 1, said releasable connector comprising a girdle strap encircling said handle, and a suspension structure attached to said girdle strap and depending from said grip.

9. The combination of claim 8, said suspension structure comprising a pair of horizontally spaced suspension straps.

10. The combination of claim 9, said suspension straps being of inverted U-shape and passing over said grip of said-first piece of luggage.

11. The combination of claim 9, and further comprising releasable fasteners on said girdle strap for connecting together opposed portions thereof.

12. The combination of claim 11, wherein said releasable fasteners are at or adjacent said suspension straps.

13. The combination of claim 11, wherein said girdle strap has an elastic portion opposite said releasable fasteners.

14. The combination of claim 8, wherein said girdle strap has free ends and a buckle thereon.

15. The combination of claim 14, wherein said girdle strap further comprises an adjustable slider.

16. The combination of claim 14, said girdle strap further comprising an elastic portion disposed opposite to said buckle, and an attachment strap being secured to said elastic portion.

17. The combination of claim 9, said girdle strap having an elastic section between said suspension straps, said girdle strap opposite said elastic section having a pair of free ends, and a releasable fastener for securing said free ends together.

18. The combination of claim 17, wherein said releasable fastener is a buckle.

19. The combination of claim 18, wherein said releasable connector comprises snap fasteners.

20. The combination of claim 8, said girdle strap having an attachment strap thereon and a pair of free ends opposite said attachment strap, and releasable connectors on said free ends.

21. The combination of claim 20, said releasable connectors being hook and loop fasteners.

22. The combination of claim 9, wherein there are a pair of elastic sections in said girdle strap, outwardly of said suspension straps.

23. The combination of claim 1, said second piece of luggage having a height at least as great as the height of the container of said first piece of luggage.

24. In combination, (a) a piece of luggage having walls providing a container, at least a part of a said wall being movable to provide access into said luggage, supporting wheels on said luggage, and a handle for said luggage comprising a grip and mounted for movement between a stored position and an extended position in which said grip is remote from and at a higher elevation than said walls, (b) a garment bag for clothes on hangers having walls providing a container and a carrying element having a grip, and (c) a releasable connector supporting said grip of said garment bag closely adjacent said grip of said first piece of luggage;

whereby, said garment bag is supported with the grip thereof substantially at the highest part of said handle of said first piece of luggage in the extended position thereof to thereby provide improved stability to said combination due to the location of the center of gravity of said garment bag while said combination is being towed.

25. A releasable connector for placement on a luggage handle having a generally transverse horizontal grip and a pair of parallel rods, and for supporting a second piece of luggage by the handle thereof, said releasable connector comprising:

(a) a pair of substantially parallel inverted U-shaped suspension straps;

(b) a girdle strap extending transversely of and connected at spaced locations thereof to said suspension straps; and (c) an attachment strap attached transversely to said girdle strap and having ends with releasable connector elements therein for securing to the handle of the second piece of luggage while it is supported from the grip of the piece of luggage by the pair of suspension straps.

26. The releasable connector construction of claim 25, wherein said girdle strap has at least one elastic portion therein to adjust the size thereof.

27. The releasable connector construction of claim 25, wherein said girdle strap has a pair of free ends, and connectors for releasable connecting said free ends.

28. The releasable connector construction of claim 25, and further comprising releasable fasteners at spaced locations on said girdle strap to releasably connect oppositely spaced portions of said girdle strap.

* * * * *